US005885302A

United States Patent [19]

Leuck

[11] Patent Number: 5,885,302

[45] Date of Patent: Mar. 23, 1999

[54] LEATHER TANNING PROCESS

[75] Inventor: Carlos Alfredo Leuck, Rio Grande do Sul, Brazil

[73] Assignee: Seta S.A.—Extrativa Tanino de Acacia, Estancia Velha, Brazil

[21] Appl. No.: 902,594

[22] Filed: Jul. 30, 1997

[30] Foreign Application Priority Data

Jul. 31, 1996 [BR] Brazil ..... 9603419-0

[51] Int. Cl.[6] ..... C14C 3/06; C14C 3/10; C14C 3/28

[52] U.S. Cl. ..... 8/94.19 R; 8/94.18; 8/94.21; 8/94.33; 8/94.26; 8/94.27; 8/94.32

[58] Field of Search ..... 8/94.18, 94.21, 8/94.33, 94.26, 94.27, 94.32, 94.19 R

[56] References Cited

U.S. PATENT DOCUMENTS 1,659,520 2/1928 Dodge ..... 8/94.18
2,880,053 3/1959 Fein et al. ..... 8/94.33
3,346,324 10/1967 Fein et al. ..... 8/94.33
4,978,361 12/1990 Fuchs et al. ..... 8/94.18

OTHER PUBLICATIONS

T.C. Thorstensen, Practical Leather Technology, pp. 284 and 288 (month unknown), 1976.

*Primary Examiner*—Alan Diamond
*Attorney, Agent, or Firm*—Gottlieb, Rackman & Reisman, P.C.

[57] ABSTRACT

The present invention refers to a new process meant for chrome and/or vegetable leather tanning. The process proposed by the invention comprises the steps of bating or purging, conditioning, and chrome and/or vegetable tannage. The conditioning step uses hydroxy-butaldehyde which reacts by blocking the amines of the collagen and releasing carboyxls. This reaction reduces the isoelectric point to 4.0–4.5, making the hide receptive or susceptible to effective chrome tannage by linking the carboxyls, or to tannin, by linking through hydrogen bridges. Hydroxy-butaldehyde is used in the conditioning step in a proportion of 2.5–3.0% as compared to the weight of the delimed hide, in a concentration of 40±2%, with a pH of 4.2–4.4, and with the reaction time being from 3 to 4 hours.

7 Claims, No Drawings

LEATHER TANNING PROCESS

The present invention refers to a new process for chrome (color) and/or vegetable leather tanning.

BACKGROUND OF THE INVENTION

The conventional process for leather tanning comprise the following operations: bating, pickling, pre-tanning and tanning.

The bating (purging or cleaning) of leather hides consists of deliming (removal of lime) and then bating the hides with enzymes. The second step is the pickling operation, where the bated hide is treated with sulfuric acid and sodium chloride in order to avoid, eliminate or reduce hide deterioration. Afterwards, the pre-tanning step is executed with chrome (chromic acid) or glutaraldehyde; this is the process that gives the hide its pretanning characteristics, allowing some operations, such as splitting, and afterwards, shawing the leather. This phase results in less steps with the use of a smaller quantity of chemicals. Finally the tanning of the hide is performed with chrome (chromic acid) and/or tannins, in accordance with the specifications to be reached.

SUMMARY OF THE INVENTION

The object of the present invention is an innovative tanning process which, through the addition of a specific product, hydroxy-butaldehyde, to the bated or purged hide or skin, results in the conditioning of the hide or skin and, later on, chrome and/or vegetable tannage thereof. This process results in the shifting of the isoelectric point that, as the reaction time passes, varies from 3.0–3.5 to 4.0–4.5, with the pH in the same range. The process proposed by the invention allows a chrome tannage, favoring its penetration as the penetration pH range is wide, varying from 4.0 to 6.0 and the optimum point between 4.0 and 6.0 matches with the one of the process of the invention.

Advantages of the present invention over conventional tanning processes are:

a. it is autobasifying, the addition of alkalis not being necessary;

b. elimination of the pickle and pre-tanning phases with the subsequent removal of sulfuric acid and sodium chloride, but creating a conditioning phase;

c. removal of sodium formate and of sodium bicarbonate used in the post-pickle treatment;

d. simplification of the effluents treatment due to the reduction of the chrome quantity and the elimination of sodium chloride (main pollution sources of the effluents);

e. reduction of the total tanning time, from 24–36 hours to 12–14 hours.

DETAILED DESCRIPTION

The tanning process of the present invention comprises the steps of bating (purging or cleaning), conditioning with hydroxy-butaldehyde, and chrome and/or vegetable tannage. The bating of the hide is performed in accordance with conventional tanning processes. The hydroxy-butaldehyde is used to condition the bated hide, allowing subsequent tanning and retanning treatments, whenever it is the case. Conditioning comprises the change of the isoelectric point of the bated hide. This is due to the hydroxy-butaldehyde reaction with the amine. The hydroxy-butaldehyde blocks the amines of the collagen (proteins found in greatest number in the hide), releasing the carboxyls. This, in turn, reduces the isolectric point, making the hide receptive and otherwise susceptible to effective chrome tannage (linking the carboxyls), or vegetable tannage (linking through hydrogen bridges). The percentage of hydroxy-butaldehyde used for conditioning varies from 2.5 to 3.0% as compared to the delimed hide weight, and the reaction time is approximately 3 to 4 hours. Afterwards, the tanning agent is added. In the case of chrome, the tanning time is approximately 6 to 7 hours. For vegetable tanning, the reaction time is approximately 12 to 14 hours.

Hydroxy-butaldehyde is obtained from the reaction of acetic aldehyde and its structural formula is the following:

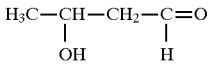

The characteristics of the product are:

mw=88.0 pH=4.2 to 4.4 concentration=40±2% of hydroxy-butaldehyde

It will thus be seen that the objects set forth above, among those made apparent from the preceding description, are efficiently attained, and since changes may be made without departing from the spirit and scope of the invention, it is understood that the above description is merely illustrative and does not otherwise limit the scope of the invention. The claims that follow define the inventive scope.

I claim:

1. A tanning process for leather comprising:

baiting a hide or skin, the hide or skin containing collagen;

conditioning the hide or skin by reacting hydroxybutaldehyde with the collagen in order to block production of amines and to release carboxyls, the hide or skin having an isoelectric point that is thereby reduced to between about 4.0 and 4.5; and tanning the hide or skin by one of chrome and vegetable tanning.

2. The process of claim 1, wherein chrome tanning is carried out by linking chrome with the released carboxyls.

3. The process of claim 1, wherein vegetable tanning is achieved by linking the released carboxyls to the tanning compound through hydrogen bonding.

4. The process of claim 1, wherein the amount of hydroxy-butaldehyde used in the conditioning step is in the range of between 2.5 and 3.0 weight percent as compared to the overall weight of the hide or skin.

5. The process of claim 1, wherein said conditioning step has a reaction time of between about three and four hours.

6. The process of claim 1, wherein chrome tanning is carried out for a time period between about six and seven hours.

7. The process of claim 3, wherein vegetable tanning is carried out for a time period of between twelve and fourteen hours.

* * * * *